US007115149B2

(12) United States Patent
Stickland et al.

(10) Patent No.: US 7,115,149 B2
(45) Date of Patent: Oct. 3, 2006

(54) CAST SEPARATOR TANK

(75) Inventors: Mark Stickland, Manchester (GB); Gunter Gray Matt, Charlotte, NC (US); Gretchen L. Carlson, Charlotte, NC (US)

(73) Assignee: Ingersoll-Rand Company, Montvale, NJ (US)

( * ) Notice: Subject to any disclaimer, the term of this patent is extended or adjusted under 35 U.S.C. 154(b) by 52 days.

(21) Appl. No.: 10/816,330

(22) Filed: Apr. 1, 2004

(65) Prior Publication Data

US 2005/0217221 A1 Oct. 6, 2005

(51) Int. Cl.
*B01D 50/00* (2006.01)

(52) U.S. Cl. ..... 55/319; 55/320; 55/420; 55/DIG. 17; 96/189; 96/416

(58) Field of Classification Search ..... 55/319, 55/320, DIG. 17, 434, 420; 96/189, 416
See application file for complete search history.

(56) References Cited

U.S. PATENT DOCUMENTS 6,736,884 B1 * 5/2004 Virgilio ..... 96/189

* cited by examiner

*Primary Examiner*—Robert A. Hopkins
(74) *Attorney, Agent, or Firm*—Michael Best & Friedrich LLP

(57) ABSTRACT

A separator tank assembly comprising a cast hollow tank and a cast lid. The cast hollow tank has a closed end and an open end having a first opening and a second opening. The cast lid has a first passage configured for fluid communication with the tank first opening and a second passage configured for sealed fluid communication with the second opening. The first passage is formed with an integral port configured to receive a pressure control valve and the second passage is formed with an integral port configured to receive an oil filter and wherein the tank is configured such that air having undergone primary separation flows through the first opening and oil within the tank flows through the second opening.

39 Claims, 9 Drawing Sheets

CAST SEPARATOR TANK

BACKGROUND

The present invention relates generally to an air compressor system and more particularly to an air/oil separator tank for use with an oil-flooded air compressor.

In conventional air compressor systems which utilize an oil-flooded compressor, air is compressed in a compression chamber or airend by a set of rotary screws, and a lubricant, such as oil, is injected into the compression chamber and mixes with the compressed air. The oil is generally injected into the compression chamber for a number of reasons including cooling the air compressor system, lubricating bearings, balancing axial forces and sealing the rotary screws. Although using oil is essential for operating these types of air compressor systems, the oil must be removed from the stream of compressed air before the compressed air may be used downstream for pneumatic equipment and/or other tools.

Thus, in such conventional air compressor systems, the compressed air and oil mixture discharged from the airend of the compressor flows with a high velocity into a separator tank where the air and oil of the air/oil mixture are caused to separate. Separator tanks are usually cylindrical tanks mounted either vertically or horizontally. In vertically mounted separator tanks, the air/oil mixture is directed tangentially around an inner wall of a separation chamber. The combination of the centrifugal forces acting on the air/oil mixture and contact between the air/oil mixture and the inner wall of the separation chamber causes much of the oil to separate from the air/oil mixture, thereby allowing gravity to draw the oil downwardly into a lower portion of the separation chamber and also allowing the air to separate from the oil and flow upwardly in the separation chamber. In horizontally mounted separator tanks, the air/oil mixture enters at high speed and collides with the end wall of the tank. The air/oil mixture then flows in the opposite direction at a slower velocity due to an increase in diameter. The impingement followed by a slowed velocity allows gravity to draw the oil downwardly into a lower portion of the separation chamber. Both of these types of separation effects are known in the art as primary separation.

As generally known, an air/oil separator tank for an oil-flooded air compressor system generally provides two functions. The separator tank provides a means to separate oil from the air/oil mixture introduced into the separation chamber as described above and it also functions as an oil sump for the compressor system.

Conventional air compressor systems as described above include multiple hoses, tubes, pipes or the like and associated fittings connecting a compressor to a separator tank. Hoses and associated fittings provide potential leak paths which, if developed, could adversely affect the overall operation of the compressor system. Using hoses and associated fittings also requires additional assembly time. Thus, there is a need for an air compressor system which eliminates or at least reduces the number of hoses and associated fittings used to connect a compressor to a separator tank.

As commonly understood, conventional air compressor systems as described above include a motor or drivetrain to operate the compressor. Since conventional air compressor systems use a hose, typically a flexible hose, to connect the compressor to a separator tank, the drivetrain, the compressor and the separator tank are not securely attached as a single unit, thereby making it virtually impossible to maneuver the entire compressor system as one. In addition, since the compressor and the separator tank are individual units, each is provided with its own isolation or supporting mounts, thereby adding undesirable cost to the overall compressor system. Thus, there is a need for an air compressor system which is easier to handle and which is assembled together in such a way that the entire compressor system can be handled or moved as a single unit, and which is also mountable to an associated subbase, so as to provide a more cost effective compressor system.

SUMMARY

The present invention provides a separator tank assembly comprising a cast hollow tank and a cast lid. The cast hollow tank has a closed end and an open end having a first opening and a second opening. The cast lid has a first passage configured for fluid communication with the tank first opening and a second passage configured for sealed fluid communication with the second opening. The first passage is formed with an integral port configured to receive a pressure control valve and the second passage is formed with an integral port configured to receive an oil filter and wherein the tank is configured such that air having undergone primary separation flows through the first opening and oil within the tank flows through the second opening.

DETAILED DESCRIPTION OF THE PREFERRED EMBODIMENTS

The present invention will be described with reference to the accompanying drawing figures wherein like numbers represent like elements throughout. Certain terminology, for example, "top", "bottom", "right", "left", "front", "frontward", "forward", "back", "rear" and "rearward", is used in the following description for relative descriptive clarity only and is not intended to be limiting.

Figure 1:
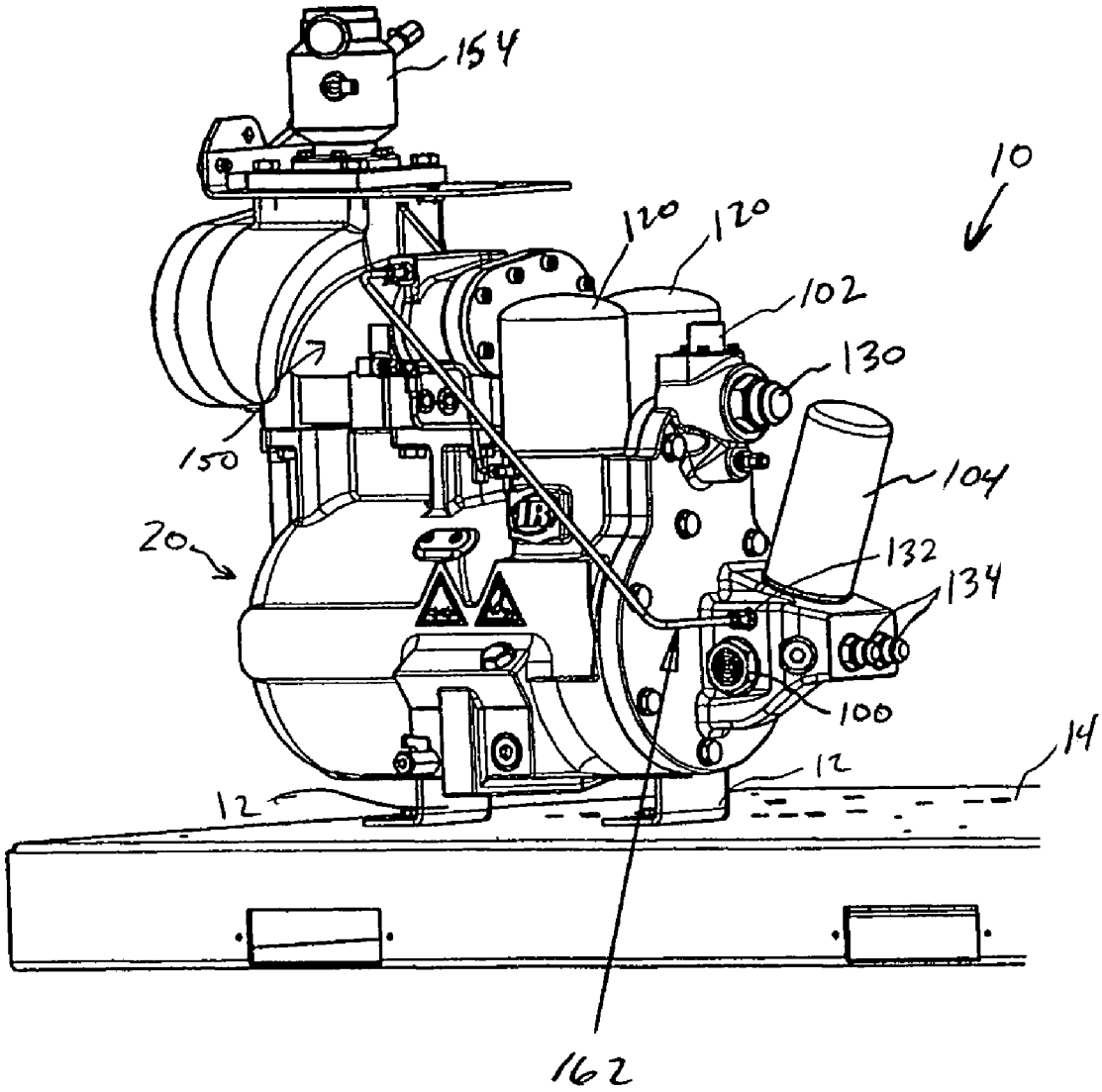
FIG. 1 is an isometric view of a compressor assembly incorporating a separator tank in accordance with a first embodiment of the present invention.
Figure 2:
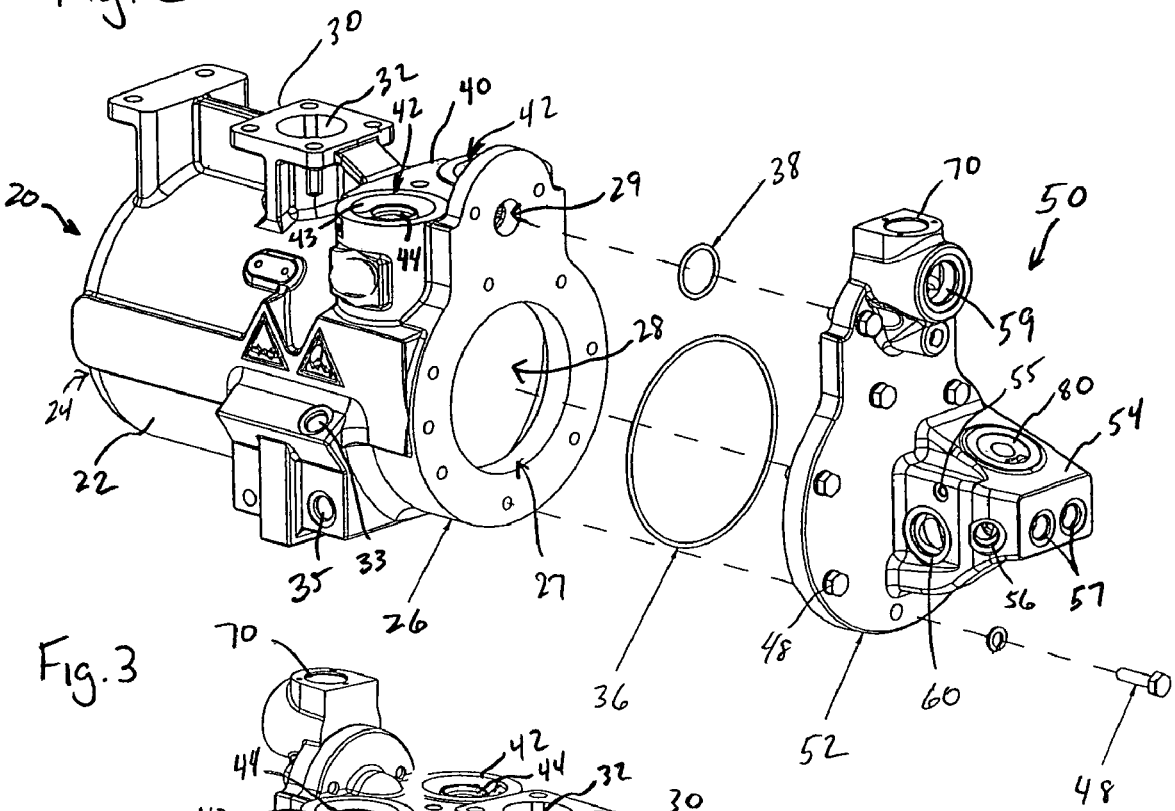
FIG. 2 is an exploded front, right isometric view of the separator tank of FIG. 1.
Figure 3:
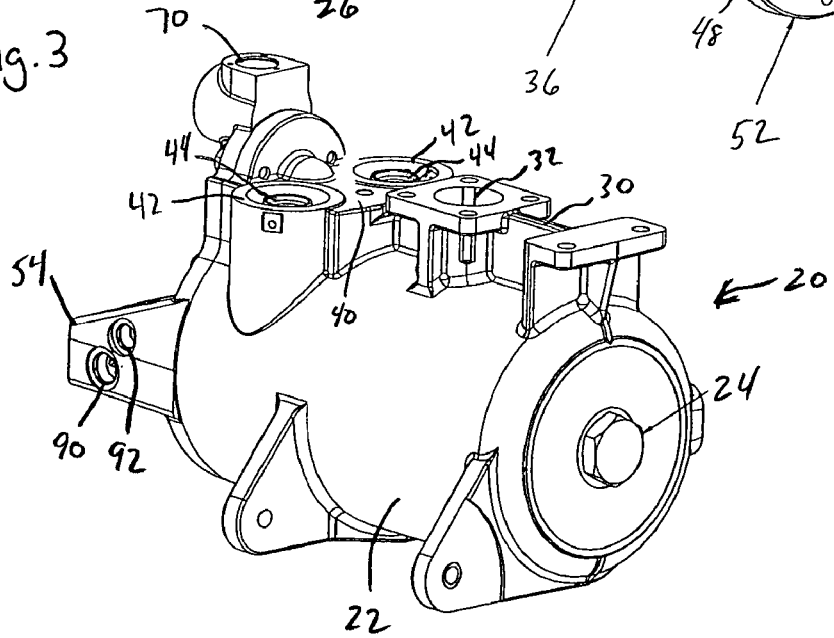
FIG. 3 is a rear, left isometric view of the separator tank of FIG. 1.
Figure 4:
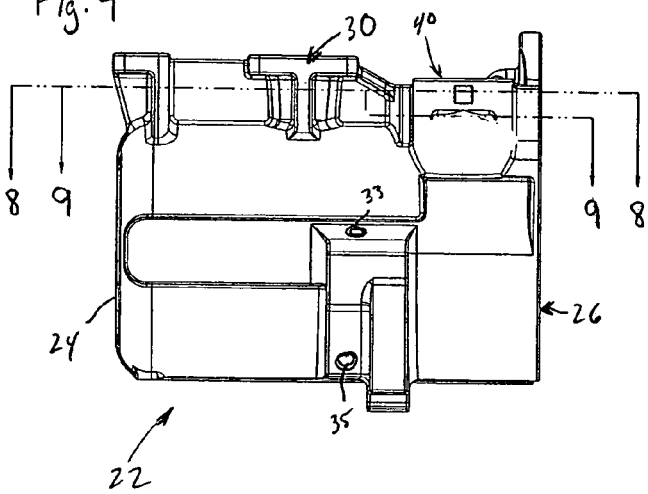
FIG. 4 is a side elevation view of the cast tank of the separator tank of FIG. 1.

Referring to FIG. 1, an air compressor system 10 incorporating a separator tank 20 that is a first embodiment of the present invention is shown. It should be understood that the present invention is capable of use in other compressor systems and the air compressor system 10 is merely shown and described as an example of one such system.

The air compressor system 10 illustrated in FIG. 1 includes a compressor 150, a motor (not shown), and a separator tank 20. A feature of the present invention is that the separator tank 20 is a cast separator tank, rather than a fabricated steel tank as is the case for many conventional separator tanks. The compressor 150 is an oil-flooded, rotary screw air compressor. Air enters the compressor 150 through an air intake 154 and is compressed by rotary screws (not shown) found within the air compressor 150. Oil is injected into the compressor 150 to lubricate the rotary screws and a gearbox (not shown) which drives the rotary screws. The oil further serves as a sealing means for the compressor 150. The compressed air and some of the oil travel out of the rotary screws through an airend discharge opening and into an airend inlet opening 32 in the cast separator tank 20. The cast separator tank 20 serves to separate oil from the compressed air and also serves as an oil sump for the oil used to lubricate the rotary screws, the gearbox and other components.

Referring to FIGS. 2–10, the separator tank 20 generally comprises a cast cylindrical tank 22 and a cast lid 50. The cast tank 22 has a cast closed end 24 and a substantially open end 26. The open end 26 has a primary opening 27 into the hollow separation chamber 28 within the cast tank 22. A secondary opening 29 extends out from the open end 26, the function of which will be described hereinafter. A compressor support structure 30 is preferably integrally cast along the upper surface of the cast tank 22 and includes a tank air inlet 32 that is configured to receive air from the compressor 150 discharge outlet (not shown). The cast tank 22 is illustrated as a horizontal configuration, but may also formed as a vertical tank. Additionally, the compressor support structure 30 may be positioned in a different position than on the upper surface of the cast tank 22. The cast tank 22 is preferably provided with an oil fill port 33 and an oil drain port 35 that are plugged in operation.

Figure 5:
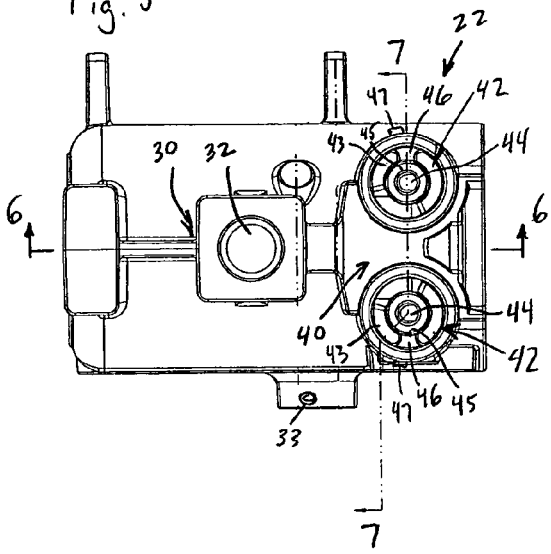
FIG. 5 is a top plan view of the cast tank of FIG. 4.
Figure 6:
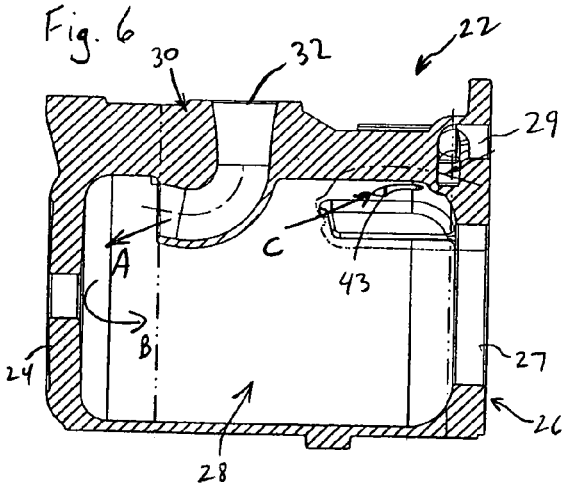
FIG. 6 is a section view along the line 6—6 in FIG. 5.
Figure 7:
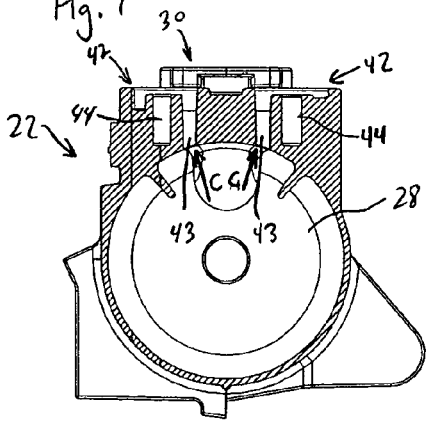
FIG. 7 is a section view along the line 7—7 in FIG. 5.
Figure 8:
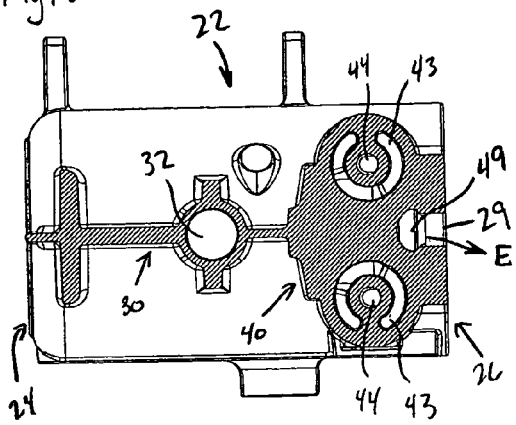
FIG. 8 is a section view along the line 8—8 in FIG. 4.
Figure 9:
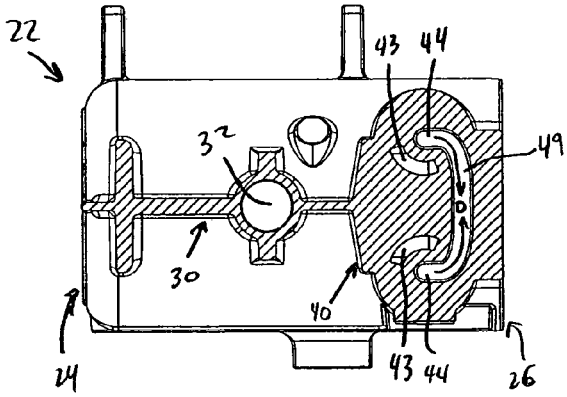
FIG. 9 is a section view along the line 9—9 in FIG. 4.
Figure 10:
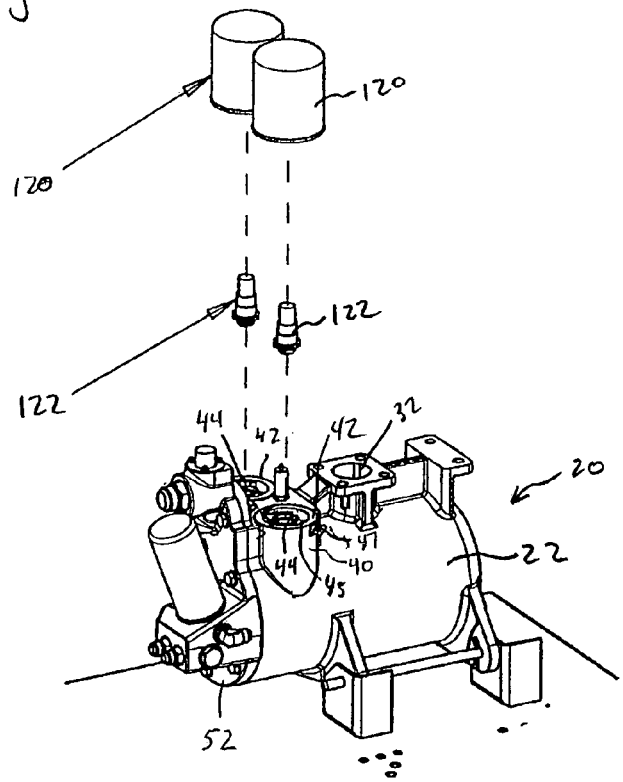
FIG. 10 is an isometric view of the separator tank of FIG. 1 illustrating attachment of the separator elements thereto.
Figure 11:
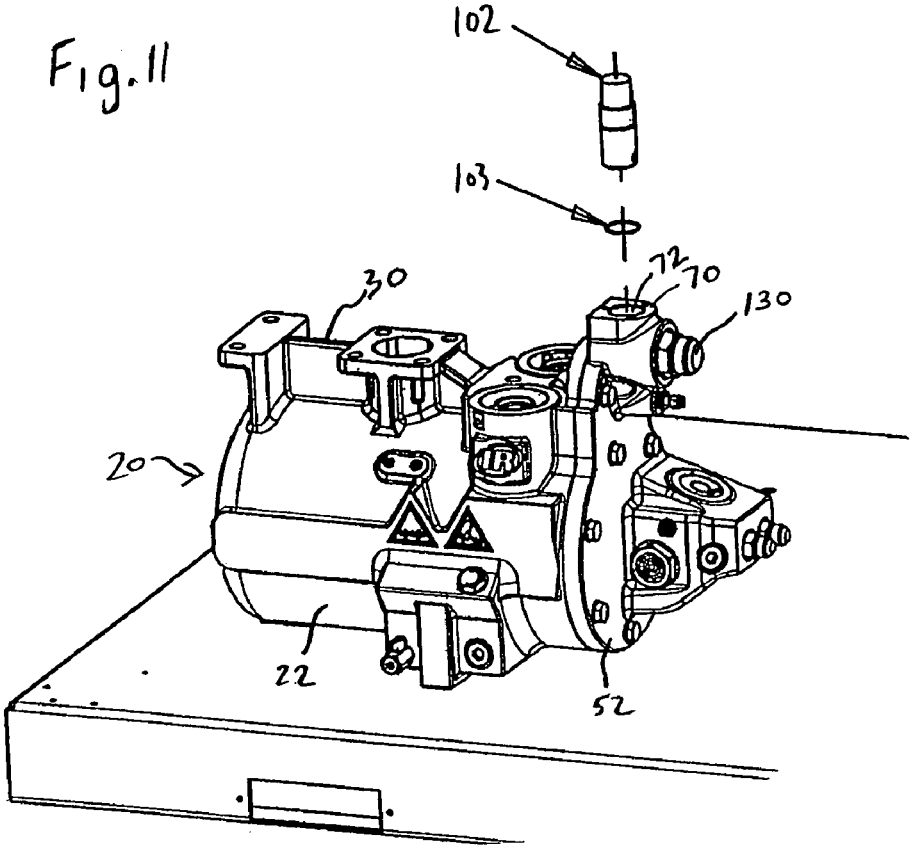
FIG. 11 is an isometric view of the separator tank of FIG. 1 illustrating attachment of the minimum pressure check valve (MPCV) thereto.
Figure 12:
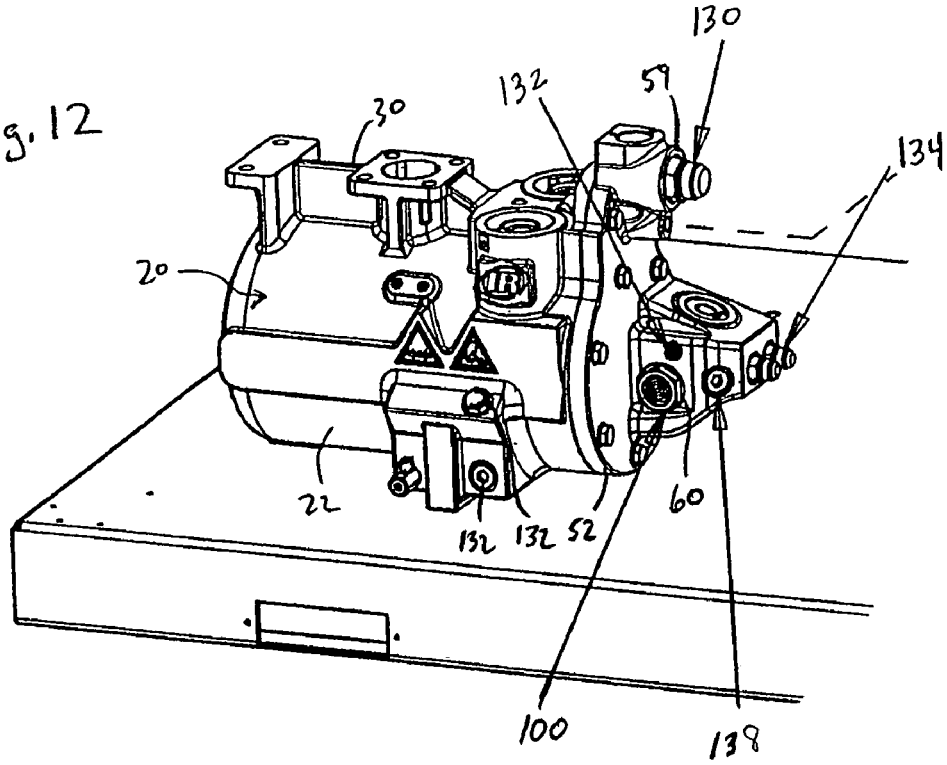
FIG. 12 is an isometric view of the separator tank of FIG. 1 illustrating the sight glass attached thereto.
Figure 22:
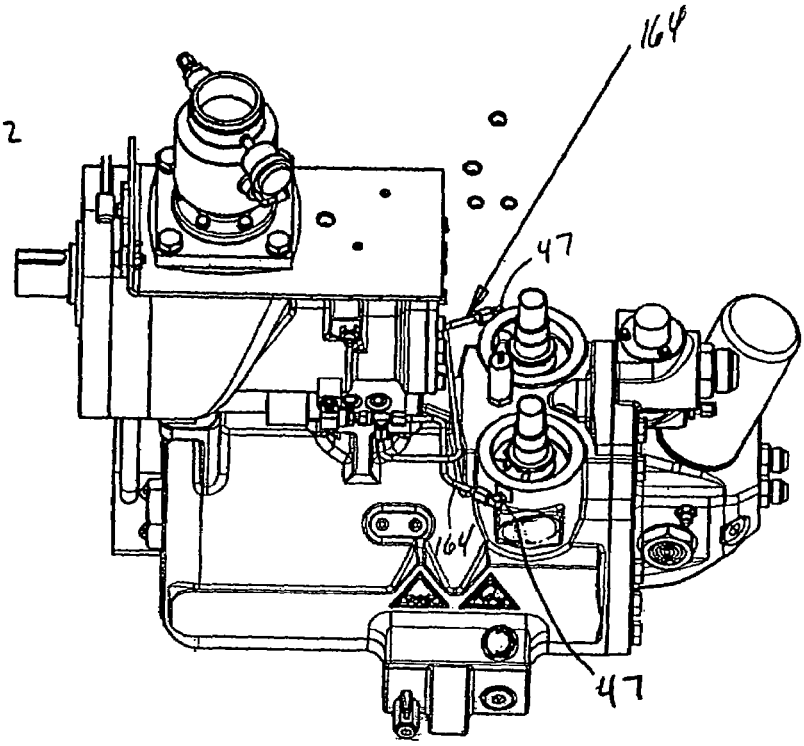
FIGS. 22 and 23 are isometric views of the separator tank of FIG. 1 illustrating attachment of a minimum number of external tubes.

Referring to FIGS. 4–10, the cast tank 22 has an integrally formed separator support 40. The separator support 40 includes a pair of ports 42. Each port 42 includes an outer passage 43 that is in communication with the separation chamber 28. A central passage 44 is provided in each port 42. Referring to FIG. 10, each central passage 44 is configured to receive a nipple 122 which serves to connect a separator element 120 to each port 42. As shown in FIG. 5, a reservoir 45 is provided about each central opening 44. A radially outward bridge 46 connects each reservoir with a port 47 connected with a scavenge tube 164 that delivers the separated oil back to the separator chamber 28 (see FIG. 22).

Flow through the separator tank 22 and separator elements 120 will be described with reference to FIGS. 6-9. The air/oil mixture enters through the air inlet 32 and collides with the tank closed end 24 as indicated by arrow A in FIG. 6. The air/oil mixture flow turns and travels across the tank chamber 28 with a slower velocity, as indicated by arrow B in FIG. 6. The impingement and reduced velocity flow causes primary separation of the air/oil mixture. The air that has undergone primary separation flows through the passages 43, as indicated by arrow C in FIGS. 6 and 7, and through the respective separator element 120 connected to the port 42. The separator element 120 removes oil entrained in the air flow and then directs the cleaned air down through the nipple 122 to the respective central passage 44. Removed oil flows to the reservoirs 45 and to the ports 47 via the bridges 46. As indicated by arrows D in FIG. 9, the air flowing through the two central passages 44 flow to through a common tube 49. The flow through the common tube 49 then flows to the opening 29 as indicated by arrow E in FIG. 8. The opening 29 is connected in communication with a passage 76 in the cast lid 50, as will be described hereinafter.

The cast lid 50 includes a main planar surface 52 and a component support section 54. The planar surface 52 is configured to cover the primary and secondary openings 27, 29 of the tank 22. The component support section 54 is formed integral with the planar surface 52. The cast lid 50 includes integrally formed connector ports 55, 57, 59 and 92, plug ports 56 and component ports 60, 70, 80, 90. Internal flow passages formed integrally within the lid 50 interconnect the various ports 55, 57, 59, 92, 56, 60, 70, 80 and 90 as will be described hereinafter. The cast lid 50 is connected to the open end 26 of the tank 22 via bolts 48 or the like. Preferably seal rings 36, 38 or the like are positioned between the lid 50 and the tank 22.

Referring to FIGS. 11–21, the various ports 55, 57, 59, 92, 56, 60, 70, 80 and 90 will be described. Referring to FIGS. 11 and 15–21, a passage 76 extends from the back of the cast lid 50 and is configured to align with and receive the air discharged through opening 29. The passage 76 is in communication with component port 70 and an outlet port 59. Component port 70 has an opening 72 configured to receive an MPCV 102 with an associated washer 103 or the like. The MPCV 102 controls flow of discharged air between the separator opening 29 and port 59. The MPCV 102 prevents flow to the port 59 until a minimum amount of pressure has built up within the separation chamber 28. Once the minimum pressure is reached, the air flows to port 59 that receives a connector 130 configured to be connected with downstream components (not shown) of the air compressor system 10.

Figure 16:
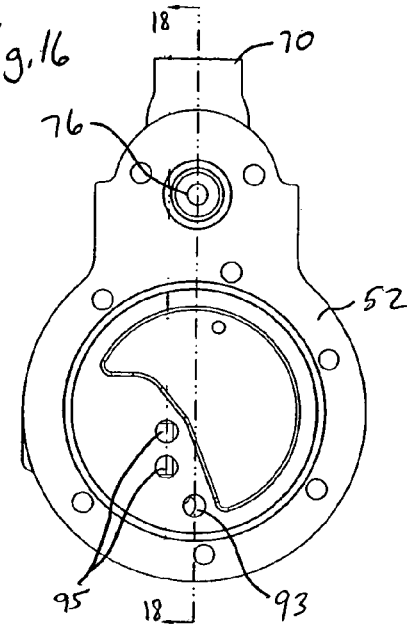
FIG. 16 is a rear elevation view of the separator tank lid of the separator tank of FIG. 1.

Referring to FIG. 16, opening 27 of the cast tank 22 is in fluid communication with passages 93 and 95 in the cast lid 50. The oil that collects in the separation chamber 28 flows through the passages 93 and 95 in to the cast lid 50. Referring to FIGS. 12 and 15–20, passage 95 is in communication with component port 60. Component port 60 is configured to receive a sight glass 100. The sight glass 100 allows observation of the amount of oil flowing through passage 95. Since passage 95 is located higher than passage 93, oil flowing through passage 95 and seen through sight 100 will confirm that the separator tank 20 has sufficient oil for the oil to flow through the lower passage 93.

Figure 13:
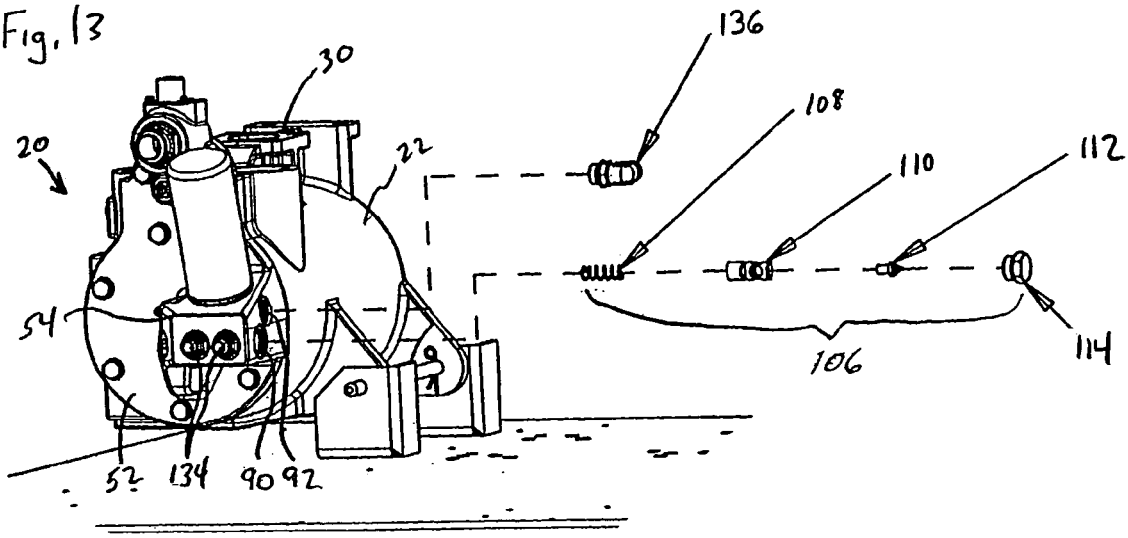
FIG. 13 is an isometric view of the separator tank of FIG. 1 illustrating attachment of the thermal valve thereto.

Referring to FIGS. 13 and 15–21, passage 93 is in fluid communication with an internal passage 97 that is in communication with component port 90 that is configured to receive a thermal valve assembly 106, see FIG. 13. The illustrated thermal valve assembly 106 comprises a spring 108, a cage 110, an actuator 112 and a plug 114. Other thermal valve configurations can also be utilized. The thermal valve assembly 106 is configured to control flow of oil from the passage 93 to an oil filter 104. Passage 97 is in communication with a pair of ports 57*a* and 57*b* and with a passage 84 to the oil filter 104. The thermal valve assembly 106 monitors the temperature of the oil. If the oil is sufficiently cool, the thermal valve assembly 106 allows the oil to flow to the passage 84. If the oil is too hot, the thermal valve assembly 106 will direct at least a portion of the oil to flow to port 57*a*. A connector 134 is provided in port 57 and is configured for connection to a cooler (not shown). The oil flows through the port 57*a* to the cooler. The cooled oil will flow back to the thermal valve 106 through the connector 134 positioned in the other port 57*b*. The cooled oil is then directed through the passage 84 to the oil filter 104. A plug 138 is provided in port 56 that can be utilized to drain the passage 93 if necessary.

Figure 14:
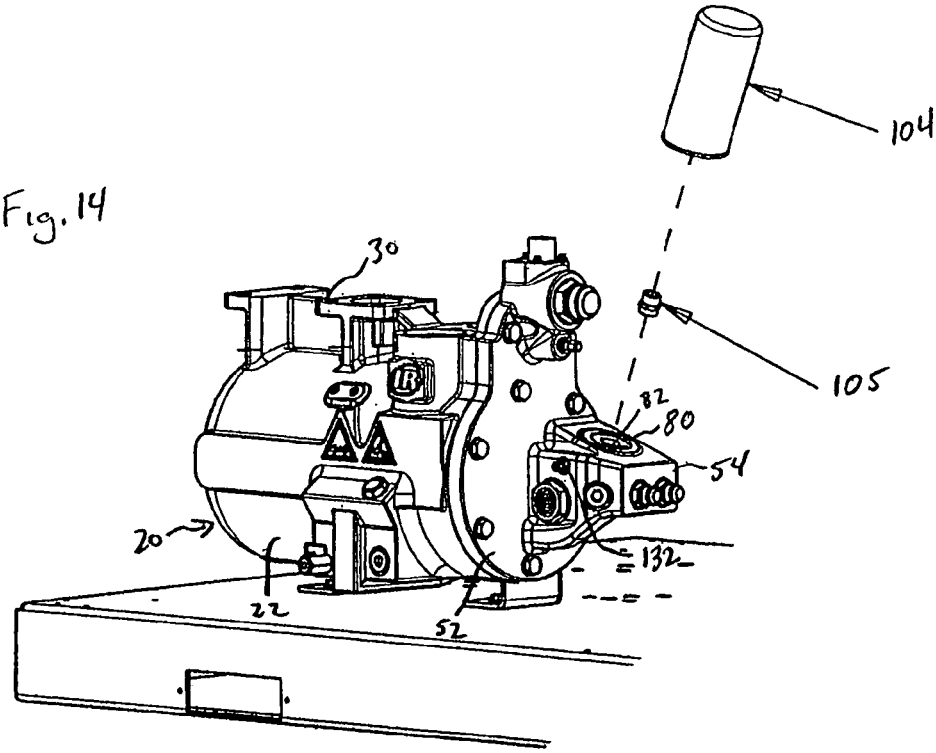
FIG. 14 is an isometric view of the separator tank of FIG. 1 illustrating attachment of the cooling fluid filter thereto.
Figure 15:
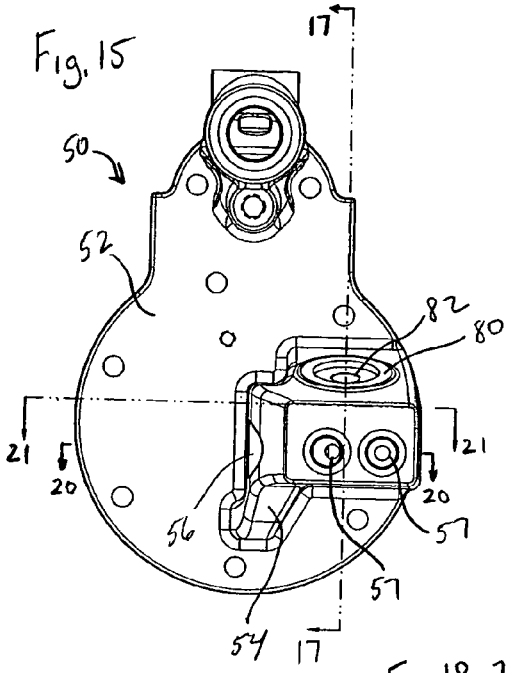
FIG. 15 is a front elevation view of the separator tank lid of the separator tank of FIG. 1.
Figure 17:
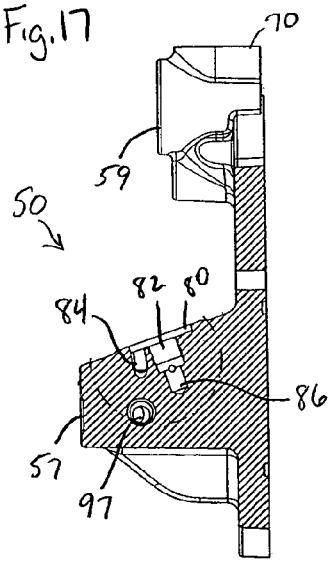
FIG. 17 is a section view along the line 17—17 in FIG. 15.
Figure 18:
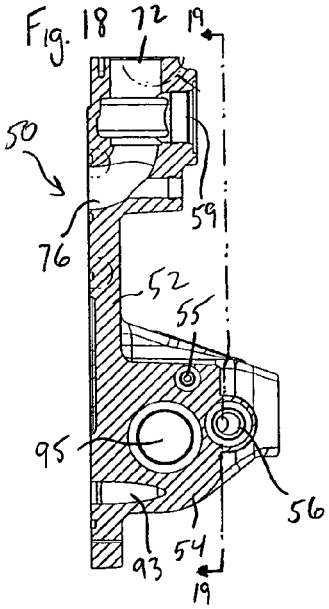
FIG. 18 is a section view along the line 18—18 in FIG. 16.
Figure 19:
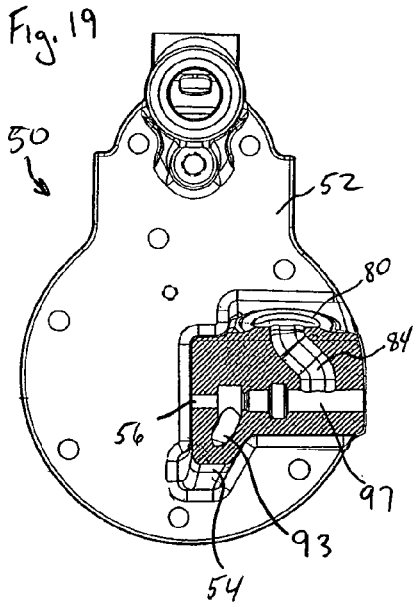
FIG. 19 is a section view along the line 19—19 in FIG. 18.
Figure 20:
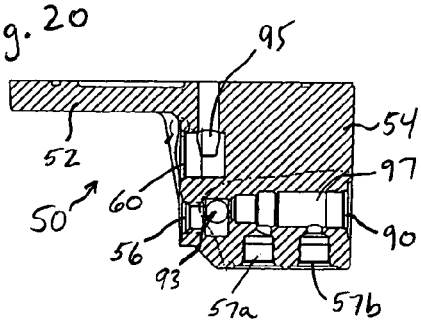
FIG. 20 is a section view along the line 20—20 in FIG. 15.
Figure 21:
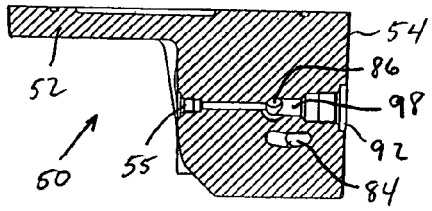
FIG. 21 is a section view along the line 21—21 in FIG. 15.
Figure 23:
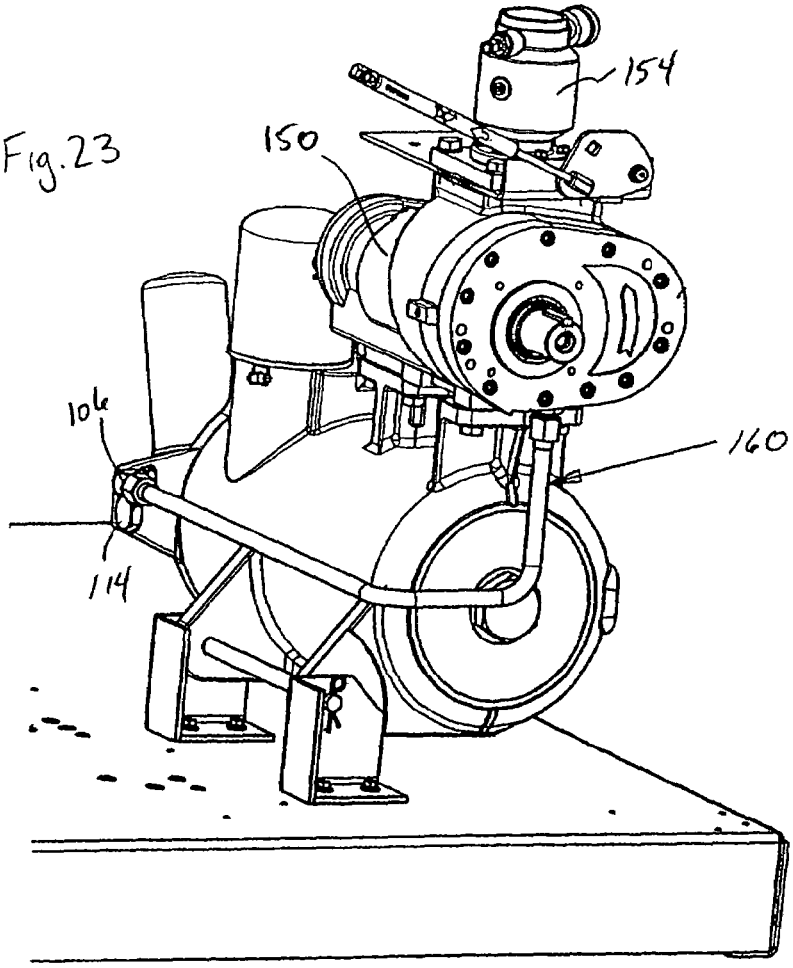

FIG. 14 illustrates connection of the oil filter 104 to connection port 80. A nipple 105 or the like is positioned between a threaded opening 82 in the connection port 80 and the filter 104. Oil flows through passage 97, through passage 84 and in to the oil filter 104. The cleaned oil flows out of the oil filter 104 through passage 86. As illustrated in FIGS. 17 and 21, passage 86 is connected with a pair of passages 96 and 98 that are in turn connected to ports 55 and 92, respectively. Ports 55 and 92 are provided with connectors 132, 136 configured for connection to tubing 160, 162 that carries cleaned, separated oil back to the compressor assembly 150 (see FIGS. 1 and 23).

Figure 24:
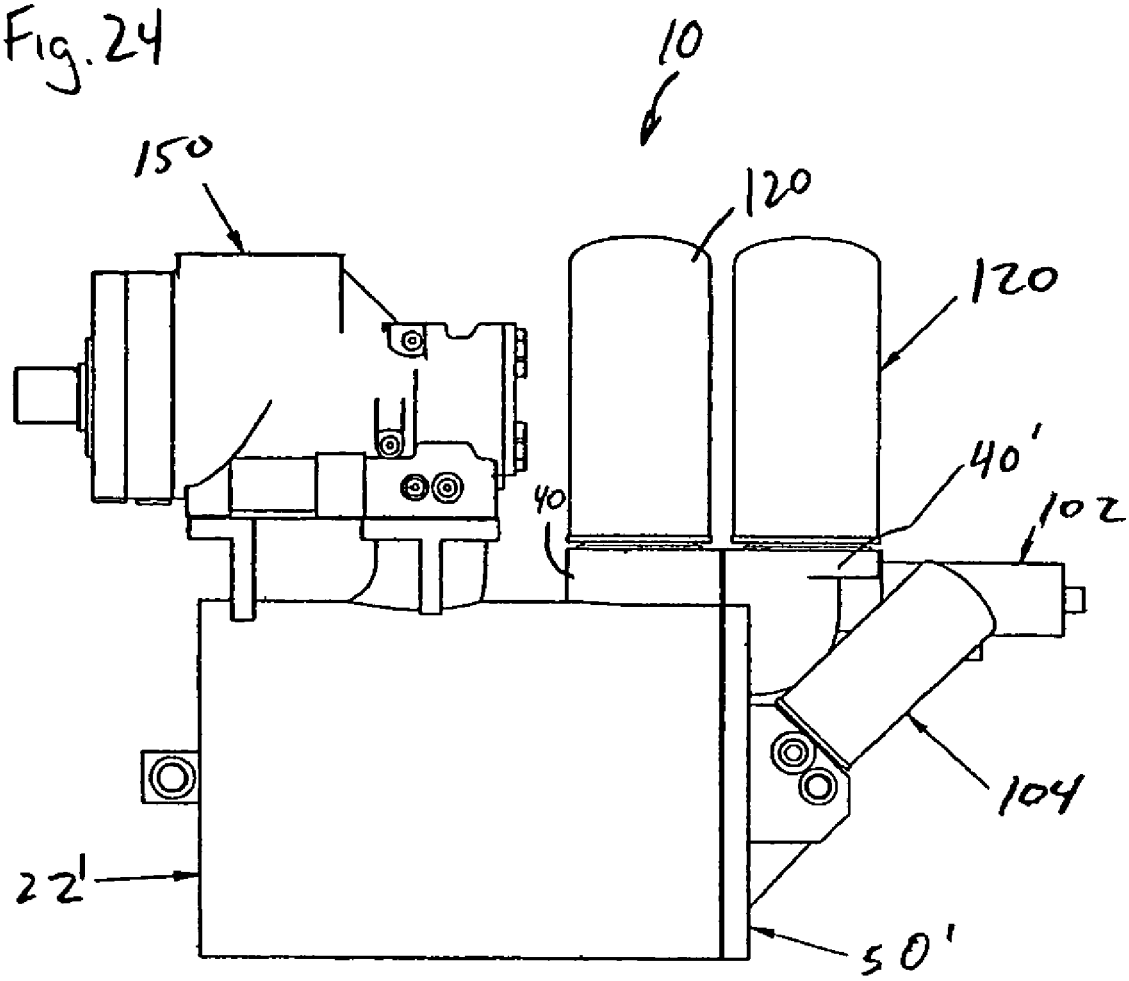
FIG. 24 is a side elevation view of an alternate embodiment of the separator tank of the present invention.

Referring to FIG. 24, an air compressor system 10' that is an alternate embodiment of the present invention is shown. The air compressor system 10' is substantially the same as the previous embodiment and includes a cast tank 22 and a cast lid 22'. The cast tank 22' supports the compressor assembly 150 and includes a single integral mount 40 for a separator element 120. The mount 40' for a second separator element 120 is formed integral with the cast lid 50'. The second embodiment illustrates that the various components can be cast in different positions and configurations.

What is claimed is:

1. A separator tank assembly comprising:

a cast hollow tank having a closed end and an open end with a separator chamber therebetween;

a cast lid substantially closing the tank open end;

a first integral fluid passage integrally cast in the cast hollow tank and cast lid and extending from the separator chamber to at least one external port, wherein the first integral fluid passage is a compressed air passage and wherein at least a first integral port is formed along the first integral fluid passage between the separator chamber and the external port;

wherein the first integral port is configured to receive a separator element; and wherein the first integral port has a first integral separator passage extending from the first integral fluid passage to the separator element and a second integral separator passage extending from the separator element to the first integral fluid passage such that compressed air travels from the separator chamber, through the first integral fluid passage, through the first separator passage, through the separator element, through the second separator passage and through the first integral fluid passage to the external port.

2. The separator tank assembly of claim 1 wherein the cast tank has a separator element mounting surface formed integral therewith about the first integral port.

3. The separator tank assembly of claim 1 further comprising a second integral port formed along the first integral fluid passage between the first integral port and the external port.

4. The separator tank assembly of claim 3 wherein the second integral port is configured to receive a minimum pressure check valve which prevents passage of the compressed air through the first integral fluid passage to the external port unless an air pressure within the separator chamber is above a predetermined level.

5. The separator tank assembly of claim 3 wherein the first integral port is formed integrally with the cast tank and the second integral port is formed integrally with the cast lid.

6. The separator tank assembly of claim 1 wherein the first integral port is configured to receive a minimum pressure check valve which prevents passage of the compressed air through the first integral fluid passage to the external port unless an air pressure within the separator chamber is above a predetermined level.

7. The separator tank assembly of claim 1 wherein the external port is configured for providing compressed air to an external component.

8. The separator tank assembly of claim 1 wherein the first integral fluid passage is a lubricant passage and wherein at least a first integral port is formed along the first integral fluid passage between the separator chamber and the external port.

9. The separator tank assembly of claim 8 wherein the first integral port is configured to receive a thermal valve assembly.

10. The separator tank assembly of claim 9 further comprising a second integral port formed along the first integral fluid passage between the first integral port and the external port.

11. The separator tank assembly of claim 10 wherein the second integral port is configured to receive a lubricant filter.

12. The separator tank assembly of claim 11 wherein the thermal valve assembly is configured to direct flow of lubricant either directly to the second integral port or through a secondary passage associated with a cooler prior to flow to the second integral port.

13. The separator tank assembly of claim 11 wherein the first and second integral ports are formed integrally with the cast lid.

14. The separator tank assembly of claim 8 wherein the first integral port is configured to receive a lubricant filter.

15. The separator tank assembly of claim 14 wherein the first integral port has a first integral filter passage extending from the first integral fluid passage to the lubricant filter and a second integral filter passage extending from the lubricant filter to the first integral fluid passage such that lubricant travels from the separator chamber, through the first integral fluid passage, through the first filter passage, through the lubricant filter, through the second filter passage and through the first integral fluid passage to the external port.

16. The separator tank assembly of claim 15 wherein the external port is configured for returning cleaned lubricant to an associated compressor assembly.

17. The separator tank assembly of claim 8 wherein a second integral fluid passage extends between the separator chamber and a second integral port configured to receive a sight glass.

18. A separator tank assembly comprising:

a cast hollow tank having a closed end and an open end with a separator chamber therebetween;

a cast lid substantially closing the tank open end;

a first integral fluid passage integrally cast in the cast hollow tank and cast lid and extending from the separator chamber to a first external port configured for providing compressed air to an external component;

a second integral fluid passage integrally cast in the cast hollow tank and cast lid and extending from the separator chamber to a second external port configured for returning cleaned lubricant to an associated compressor assembly;

wherein at least a first integral port is formed along the first integral fluid passage between the separator chamber and the first external port;

wherein the first integral port is configured to receive a separator element; and wherein the first integral port has a first integral separator passage extending from the first integral fluid passage to the separator element and a second integral separator passage extending from the separator element to the first integral fluid passage such that compressed air travels from the separator chamber, through the first integral fluid passage, through the first separator passage, through the separator element, through the second separator passage and through the first integral fluid passage to the first external port.

19. The separator tank assembly of claim 18 wherein the first integral port further comprises a lubrication reservoir adjacent the second separator passage, the reservoir configured to receive lubricant separated by the separator element.

20. The separator tank assembly of claim 19 wherein an integral scavenge passage extends between the reservoir and an external scavenge port.

21. The separator tank assembly of claim 18 wherein the cast tank has a separator element mounting surface formed integral therewith about the first integral port.

22. The separator tank assembly of claim 18 further comprising a second integral port formed along the first integral fluid passage between the first integral port and the first external port.

23. The separator tank assembly of claim 22 wherein the second integral port is configured to receive a minimum pressure check valve which prevents passage of the compressed air through the first integral fluid passage to the first external port unless an air pressure within the separator chamber is above a predetermined level.

24. The separator tank assembly of claim 22 wherein the first integral port is formed integrally with the cast tank and the second integral port is formed integrally with the cast lid.

25. The separator tank assembly of claim 18 wherein the first integral port is configured to receive a minimum pressure check valve which prevents passage of the compressed air through the first integral fluid passage to the first external port unless an air pressure within the separator chamber is above a predetermined level.

26. The separator tank assembly of claim 18 wherein a third integral port is formed along the second integral fluid passage between the separator chamber and the second external port.

27. The separator tank assembly of claim 26 wherein the third integral port is configured to receive a thermal valve assembly.

28. The separator tank assembly of claim 27 further comprising a fourth integral port formed along the second integral fluid passage between the third integral port and the second external port.

29. The separator tank assembly of claim 28 wherein the fourth integral port is configured to receive a lubricant filter.

30. The separator tank assembly of claim 29 wherein the thermal valve assembly is configured to direct flow of lubricant either directly to the fourth integral port or through a secondary passage associated with a cooler prior to flow to the fourth integral port.

31. The separator tank assembly of claim 29 wherein the third and fourth integral ports are formed integrally with the cast lid.

32. The separator tank assembly of claim 26 wherein the third integral port is configured to receive a lubricant filter.

33. The separator tank assembly of claim 32 wherein the third integral port has a first integral filter passage extending from the second integral fluid passage to the lubricant filter and a second integral filter passage extending from the lubricant filter to the second integral fluid passage such that lubricant travels from the separator chamber, through the second integral fluid passage, through the first filter passage, through the lubricant filter, through the second filter passage and through the second integral fluid passage to the second external port.

34. The separator tank assembly of claim 18 wherein a third integral fluid passage extends between the separator chamber and a fifth integral port configured to receive a sight glass.

35. The separator tank assembly of claim 1 wherein the first integral port further comprises a lubrication reservoir adjacent the second separator passage, the reservoir configured to receive lubricant separated by the separator element.

36. The separator tank assembly of claim 35 wherein an integral scavenge passage extends between the reservoir and an external scavenge port.

37. A separator tank assembly comprising:

a cast hollow tank having a closed end and an open end with a separator chamber therebetween;

a cast lid substantially closing the tank open end; and a first integral fluid passage integrally cast in the cast hollow tank and cast lid and extending from the separator chamber to at least one external port;

wherein at least a first integral port is formed along the first integral fluid passage between the separator chamber and the external port, wherein the first integral port is configured to receive a minimum pressure check valve which prevents passage of the compressed air through the first integral fluid passage to the external port unless an air pressure within the separator chamber is above a predetermined level; and wherein a housing for the minimum pressure check valve is integrally cast into the cast tank and cast lid.

38. A separator tank assembly comprising:

a cast hollow tank having a closed end and an open end with a separator chamber therebetween;

a cast lid substantially closing the tank open end;

a first integral fluid passage integrally cast in the cast hollow tank and cast lid and extending from the separator chamber to at least one external port;

wherein a second integral fluid passage extends between the separator chamber and a second integral port configured to receive a sight glass; and wherein a housing for the sight glass is integrally cast into the cast tank and cast lid.

39. A separator tank assembly comprising:

a cast hollow tank having a closed end and an open end with a separator chamber therebetween;

a cast lid substantially closing the tank open end;

a first integral fluid passage integrally cast in the cast hollow tank and cast lid and extending from the separator chamber to at least one external port;

wherein the cast hollow tank is a horizontal tank;

wherein the open end has a vertical surface; and wherein the cast lid has a vertical surface mating with the vertical surface of the open end.

* * * * *